United States Patent [19]

Kawase

[11] Patent Number: 4,852,233

[45] Date of Patent: Aug. 1, 1989

[54] METHOD OF MANUFACTURING EXTRUDED FLAT MULTIHOLE ALUMINUM TUBE FOR HEAT-EXCHANGER

[75] Inventor: Hiroshi Kawase, Tokyo, Japan

[73] Assignee: Furukawa Aluminum Co., Ltd., Tokyo, Japan

[21] Appl. No.: 222,251

[22] Filed: Jul. 21, 1988

[30] Foreign Application Priority Data

Jul. 27, 1987 [JP] Japan ..... 62-187308
Apr. 8, 1988 [JP] Japan ..... 63-85119

[51] Int. Cl.[4] ..... B21D 53/02

[52] U.S. Cl. ..... 29/157.3 R; 29/157.4; 29/527.4; 29/557

[58] Field of Search ..... 29/157.3 R, 157.4, 527.4, 29/557, DIG. 39, 157 T; 72/269, 253.1, 260, 259; 427/423, 328

[56] References Cited

U.S. PATENT DOCUMENTS 3,224,088 12/1965 McNelly ..... 29/460
3,596,495 8/1971 Huggins ..... 29/157.3 R
3,603,384 9/1971 Huggins ..... 29/157.3 R
3,708,012 1/1973 Zimprich ..... 29/157.3 R
3,711,310 1/1973 Leeper Jr. ..... 29/527.4
4,360,958 11/1982 Kritzer ..... 29/157.3 R
4,580,324 4/1986 Laska ..... 29/157.4
4,621,399 11/1986 Qureshi et al. ..... 29/527.4

FOREIGN PATENT DOCUMENTS 0160595 10/1982 Japan ..... 29/157.4
58-157522 9/1983 Japan .
58-204169 11/1983 Japan .

*Primary Examiner*—Howard N. Goldberg
*Assistant Examiner*—Irene Cuda
*Attorney, Agent, or Firm*—Oblon, Spivak, McClelland, Maier & Neustadt

[57] ABSTRACT

A method of manufacturing extruded flat multihole aluminum tube for heat exchangers is disclosed, which is characterized in that, in the hot extrusion of flat multihole Al-Cu or Al-Cu-Mn tubes, a plurality of tubes are extruded side by side in the longitudinal direction and Zn is flame sprayed onto both even surfaces of the tubes in the vicinity of the extrusion exit of the tubes to cover both even surfaces of the extruded tubes with Zn. The covering level of Zn is 3 to 30 g/m$^2$.

4 Claims, 2 Drawing Sheets

METHOD OF MANUFACTURING EXTRUDED FLAT MULTIHOLE ALUMINUM TUBE FOR HEAT-EXCHANGER

BACKGROUND OF THE INVENTION

The present invention relates to a method of manufacturing extruded flat multihole aluminum tubes for heat-exchangers by covering both even surfaces of the extruded flat multihole tubes of Al-Cu or Al-Cu-Mn alloy with Zn.

In general, since the film due to the natural oxidation on the surface of aluminum is hard and dense as in a passive state, the corrosion grows in a form of pitting corrosion. For this reason, the covering of aluminum components with Zn is very effective for giving the cathodic anticorrosion to the components. When using aluminum for the heat-exchanger of cars there can exist a salinity ($Cl^-$) depending on the environment for use, which triggers the occurrence of pitting corrosion that brings about piercing. As a method of preventing said pitting corrosion, it is known that the surface of aluminum components can be covered with a layer of low-potential Zn to be used as a sacrificial anode for the anticorrosion.

In the case of the aluminum component being a plate or an extruded material made by the mandrel system, such methods as clad rolling and clad extrusion are known for the manufacture of clad material. Also, for an extruded material by the porthole system such as a multihole flat tube, a method of dipping into the molten Zn for covering, a method of flame spraying Zn or Zn alloy onto the tube immediately after the extrusion as shown in Japanese Unexamined Patent Publication No. sho 58-204169, or a method of pressing Zn or Zn alloy against the tube immediately after the extrusion as shown in Japanese Unexamined Patent Publication No. sho 58-157522, are known. In particular, the method of flame spraying Zn onto the surface of a tube immediately after the extrusion is low in installation cost and good in workability, thus the practical utilization has been investigated as the handiest method.

However, for the multihole flat tube made of pure aluminum, for example, A 1050, which is used for the condenser of an air conditioner for cars, Zn should be flame sprayed onto the overall surface, and for this reason, it is necessary to dispose four flame spray guns at the top and bottom and right and left sides of the tube as shown in Japanese Unexamined Patent Publication No. sho 58-204169.

In order to flame spray under such conditions, single hole extrusions should be adopted for the extrusiion of the tube, in other words, only one tube can be extruded from the extruder through the die. Therefore, the productivity is very poor resulting in high cost. Generally in the case of the flat multihole tube of this type, it is common to manufacture two or four tubes simultaneously at one extrusion by providing two or four holes to the die. However, when flame spraying, the extrusion cannot avoid being conducted with one tube because of the necessity to adhere Zn to the overall surface. For this reason, the productivity is reduced by a half or one fourth and high cost is unavoidable.

As a result of extensive investigations in view of this situation, a method of manufacturing extruded flat multihole aluminum tubes for heat-exchangers that are highly corrosive resistant and yet low in cost has been developed according to the invention by combining an extrusion process for two or four tubes with a flame spraying installation and further by restricting the extruding material to Al-Cu or an Al-Cu-Mn alloy.

SUMMARY OF THE INVENTION

The method of the invention is characterized in that, in the hot extrusion of flat multihole Al-Cu or Al-Cu-Mn tubes, a plurality of tubes are extruded side by side in the longitudinal direction and Zn is flame sprayed onto both even surfaces of tubes in the vicinity of the extrusion exit of the tubes to cover both even surfaces of the extruded tubes with Zn.

DETAILED DESCRIPTION OF THE INVENTION

Zn is used in amounts of 3 to 30 g/m$^2$, preferably 6 to 20 g/m$^2$ to cover both even surfaces of a tube. Moreover, the space between respective tubes to be extruded side by side in the longitudinal direction is made to be 3 to 40 mm, preferably 10 to 30 mm to flame spray Zn. Furthermore, Zn is flame sprayed onto the even surfaces of the tubes at a position of 0.5 to 5 m, preferably 1 to 3 m apart from the face of the extrusion exit of the tubes. Besides, Zn is fed into the flame spray gun in a powdery or linear form and sprayed in the molten state. In general, Zn is used as a pure metal, but the effect thereof is not varied at all if a small quantity (0–5 wt.%) of elements such as Al, Cr, Ti, Mg, etc. is added.

Figure 1:
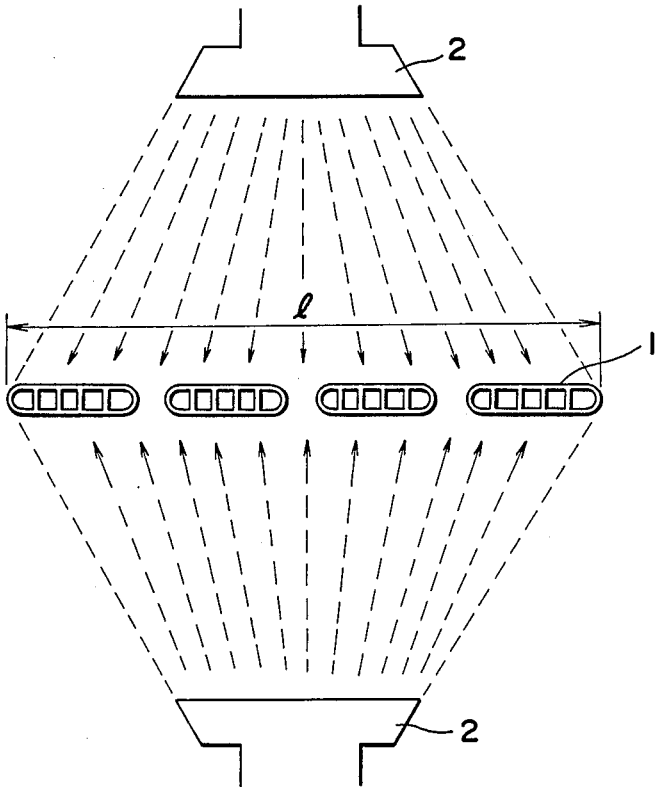
FIG. 1 is an illustration diagram showing one example of the invention.
Figure 2:
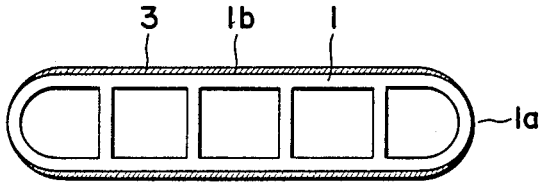
FIG. 2 is a cross section inside view showing one example of a flame sprayed tube obtained according to the invention.

According to the invention, a plurality of, for example, four flat multihole tubes (1) as shown in FIG. 1, which comprise an alloy or an Al-Cu-Mn alloy, are simultaneously extruded side by side horizontally in the longitudinal direction and flame spray guns (2) are provided above and abelow the tubes (1) in the vicinity of the extrusion exit of the tubes (1) to flame spray Zn onto the even surfaces of the tubes (1). By allowing Zn (3) to adhere to the even surfaces (**1*b*) of the flat multihole tube (1) as shown in FIG. 2, the curved portions (1*a*) (hereinafter referred to as R portions) of tube (1**) are sufficiently made anticorrosive even if Zn may not be adhering to those portions. Namely, conventional pure aluminum tubes, for example, A 1050 and A 1070 , have a very low potential to pass sufficient anticorrosive current between the Zn layer and the R portions and thus they are not made anticorrosive by this method. However, in the invention using an Al-Cu alloy or an Al-Cu-Mn alloy, the potential becomes noble and sufficient anticorrosive current passes between the Zn layer and the R portions to make the R portions anticorrosive.

Al-Cu alloys having compositions comprising 0.2 to 1.0 wt.% (hereinafter, wt.% is abbreviated as %) of Cu and the remainder of Al and inevitable impurities are preferable, and Al-Cu-Mn alloys, having compositions comprising 0.2 to 1.0% of Cu, 0.05 to 1.0% of Mn and the remainder of Al and impurities are preferable. If the alloys possess the above compositions, the potential in 5% solution of NaCl becomes not lower than −710 mV and the potential difference from the potential Zn layer of not higher than −780 mV is sufficient to make the R portions anticorrosive without the Zn layer on said R portions.

In the invention, the pitting corrosion resistance of R portions can still be more improved by adhering 3 to 30 g/m$^2$, preferably 6 to 20 g/m$^2$ of Zn to both even surfaces of the tube. The reason why the adhering level of Zn is restricted to 3 to 30 g/m$^2$ is because if the adhering level of Zn is under 3 g/m$^2$, Zn does not diffuse to the R portions upon brazing and the improvement in the pitting corrosion resistance cannot be anticipated, and, if the adhering level of Zn exceeds 30 g/m$^2$, not only does the pitting corrosion resistance becomes constant at saturation, but also melt down tends to occur undesirably upon brazing because of the high level of adherence of Zn and use of raw material increases resulting in the negativity in cost as well.

Moreover, if Zn is flame sprayed, by making the space between the respective tubes extruded side by side in the longitudinal direction 3 to 40 mm, preferably 10 to 30 mm, appropriate levels of Zn can adhere as far as the R portions and the pitting corrosion resistance is still more improved. The reason why the space between the tubes is restricted to 3 to 40 mm is because, if the space is under 3 mm, the adherence of Zn in the vicinity of the R portions of the tube becomes nonuniform and therefore the Zn either does not adhere at all or it adheres at too high a level, resulting in the problems that the improvement in the pitting corrosion resistance cannot be obtained or inversely a melt down occurs upon brazing due to the high level of adherence of Zn and the like, and if the space is over 40 mm, Zn is used wastefully through the spaces, lowering the adhering efficiency of Zn.

Furthermore, by making the flame spraying position of Zn 0.5 to 5 m, preferably 1 to 3 m apart from the exit face of the extrusion of the tube, the spaces between the tubes are stabilized and an appropriate level of adherence of Zn can be obtained. The reason why the distance from the extruding exit of the tube to the flame spraying position of Zn is restricted to 0.5 to 5 m is because if within 0.5 m, not only is the flame spraying position too close to the extruding exit, making the flame spray hard, but also the spaces between the extruded tubes are not stabilized making it impossible to obtain an appropriate level of adherence of Zn, while, if over 5 m, the adhesion of Zn having adhered becomes worse because of the lowering of the temperature of the tube below 300° C. which causes the Zn layer to be peeled off by the bending processing etc.

Besides, in the case of the flame spray guns by locating one and one below the tubes as shown in FIG. 1, the overall width (1) of extrusion does not need to be made more than 300 mm. However, if both flame spray guns are disposed either above or below the tubes, the overall width of extrusion can be extended to 600 mm at maximum.

As described, the invention is concerned with the improvement in the invention shown in Japanese Unexamined Patent Publication No. Sho 58-204169 and can provide the extrudef flat multihole aluminum tube for the heat-exchanger, wherein, in particular, the composition of the flat multihole tube to be extruded is made to be an Al-Cu alloy or an Al-Cu-Mn alloy high in potential and further, through the simultaneous extrusion of a plurality of tubes, preferably two to four, the anticorrosion is realized sufficiently by the Zn layer around the R portions, even if Zn may not be sufficiently adhering to the R portions of the flat multihole tube, to improve the productivity and to make it advantageous in cost.

In following, the invention will be illustrated based on the examples.

EXAMPLE 1

Four extruded flat aluminum tubes with a width of 22 mm, a height of 5 mm, a tube thickness of 0.7 mm and a thickness of the separating wall of 0.5 mm, and with five flow paths for the condenser, which comprise 0.4% of Cu, 0.1% Mn and the remainder of Al and which is shown in FIG. 2, were put side by side horizontally in the longitudinal direction providing a space of 20 mm each as shown in FIG. 1. They were extruded so as the overall width of extrusion becomes 250 mm and, at a position 3 m apart from the extruding exit, the flame spray guns were disposed one each above and below the flat tubes. In this way, they were drawn out horizontally with a puller (a jig to grasp the end of tube to pull) and the puller was allowed to run synchronously with the extruding velocity. After reaching a stationary velocity (about 50 m/min), the flame spray guns disposed above and below the flat tubes were allowed to work to flame spray continuously metallic Zn onto the top and bottom of the flat tubes.

After the flat tubes covered with 5 to 30 g/m$^2$ of Zn in this way were heated for about 5 minutes at 600° C., a CASS test was carried out for a month. The results are shown in Table 1 in comparison with the case of conventional flat tubes using A 1050 for aluminum material.

TABLE 1

| Manufacturing method | No. | Covering level with Zn (g/m$^2$) | Result of corrosion: Even portion | Result of corrosion: R protion |
|---|---|---|---|---|
| Method of invention | 1 | 5 | Overall corrosion | Pitting corrosion 0.3 mm |
| " | 2 | 7 | " | Pitting corrosion 0.2 mm |
| " | 3 | 10 | " | Pitting corrosion 0.1 mm |
| " | 4 | 15 | " | Overall corrosion |
| " | 5 | 20 | " | " |
| " | 6 | 25 | " | " |
| " | 7 | 30 | " | " |
| Comparative method | 8 | 5 | " | Pitting corrosion 0.7 mm (Piercing) |
| " | 9 | 10 | " | Pitting corrosion 0.6 mm (Piercing) |
| " | 10 | 20 | " | Pitting corrosion 0.6 mm |

As evident from Table 1, all of the tubes No. 1 thru 7 obtained according to the method of the invention exhibited the overall corrosion at the even portions and did not generate deep pitting corrosion particularly even at the R portions leading to good results. Whereas, in the cases of the comparative methods, in tubes No. 8 thru 10, using A 1050 for aluminum material, the even surfaces became the overall corrosion, but considerably deep pitting corrosion occurred at the R portions in all cases and, when the covering level of Zn was less, the pierced pitting corrosion (0.7 mm) occurred.

EXAMPLE 2

Figure 3:
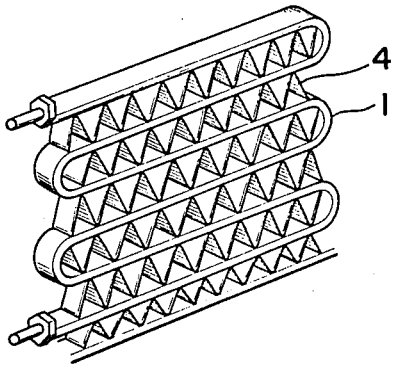
FIG. 3 is an oblique diagram showing one example of a condenser.

Flat multihole tubes comprising 0.35% of Cu, 0.2% of Mn and the remainder of Al and having the same shape as those in Example 1 were extruded and flame sprayed under the same conditions to obtain flat multihole tubes covered with Zn shown in Table 2. Using these tubes, the folding processing of tube (1) was given in a meander form as shown in FIG. 3 and, between them, the corrugate fins (4) with a tickness of 0.16 mm, which comprise BA12PC (brazing sheet), were combined. After being fixed with a stainless steel jig, they were dipped into a 10% aqueous solution of fluoride flux ($KAlF_4+K_2AlF_5 \cdot H_2O$) to coat the flux. After drying sufficiently at 120° C., they were kept for 5 minutes at 600° C. in an atmosphere of $N_2$ gas to perform the brazing.

Of these, the melt down upon the brazing was examined and, at the same time, a CASS test for a month was carried out to examine the situation of corrosion on the surface of the tubes (including R portions). The results are put down in Table 2.

TABLE 2

| Manufacturing method | No. | Covering level with Zn ($g/m^2$) | Result of corrosion | | Melt down upon brazing |
|---|---|---|---|---|---|
| | | | Even portion | R portion | |
| Method of Invention | 11 | 5 | Overall corrosion | Pitting Corrosion 0.3 mm | No |
| " | 12 | 15 | " | Overall corrosion | " |
| " | 13 | 25 | " | " | " |
| Comparative method | 14 | 2 | Pitting corrosion 0.5 mm | Pitting corrosion, Piercing | " |
| | 15 | 35 | Overall corrosion | Overall corrosion | Yes |

As evident from Table 2, all of the tubes No. 11 thru 13 obtained according to the method of the invention did not generate the melt down and exhibited the overall corrosion at the even portions and no deep pitting corrosion even at the R portions leading to good results. On the contrary, with the comparative tube No. 14, the adhering level of Zn being as low as 2 $g/m^2$, the pitting corrosion was generated and it pierced particularly at the R portions. Moreover, with the comparative tube No. 15, the adhering level of Zn being as high as 35 $g/m^2$, the corrosion was the overall corrosion, but the melt down was seen to be generated upon brazing.

EXAMPLE 3

Flat multihole tubes comprising 0.5% of Cu and the remainder of Al and having same shape as those in Example 1 were extruded varying the space between the extruded tubes, and Zn was flame sprayed onto the surfaces of the tubes similarly to Example 1, to cover with Zn in amounts of 15 $g/m^2$. The adhering efficiency of Zn to these flat tubes was examined and, at the same time, after the flat tubes were heated for about 5 minutes at 600° C., a CASS test was carried out for a month. The results are shown in Table 3.

TABLE 3

| Manufacturing method | No. | Space between tubes (mm) | Result of corrosion | | Adhering efficiency of Zn (%) |
|---|---|---|---|---|---|
| | | | Even portion | R portion | |
| Method of invention | 16 | 20 | Overall corrosion | Overall corrosion | 55 |
| " | 17 | 30 | " | " | 50 |
| " | 18 | 40 | " | " | 45 |
| Comparative method | 19 | 1 | " | Pitting corrosion piercing | 80 |
| " | 20 | 50 | " | Overall corrosion | 30 |

As evident from Table 3, with tubes No. 16 thru 18 according to the method of the invention, the corrosions at the even portions and the R portions were overall corrosions at the adhering efficiency of Zn of 45% or more. Whereas, in the case of the comparative method No. 19, the space between tubes being narrower, serious melt down occurred resulting in the deep pitting corrosion at the R portions by CASS test. Also, in the case of the comparative method No. 20, the space between tubes being wider, both even portions and R portions were corroded by the overall corrosion, but the adhering efficiency of Zn was as low as 30% showing that Zn was used wastefully through the spaces.

EXAMPLE 4

In Example 1, the position for the installation of the flame spray guns to be provided in the vicinity of the extrusion exit was varied, and metallic Zn was continuously flame sprayed onto the top and bottom of the flat the tubes to cover the surfaces of tubes with Zn amounting to 15 $g/m^2$.

Of the tubes covered with Zn in this way, the uniformity of the adherence of Zn and the adhesion at the time of bending of Zn were examined. The results are shown in Table 4.

TABLE 4

| Manufacturing method | No. | Position of flame spraying (m) | Uniformity of adherence of Zn | Adhesion of Zn |
|---|---|---|---|---|
| Method of Invention | 21 | 0.5 | Good | Good |
| " | 22 | 1 | " | " |
| " | 23 | 3 | " | " |
| " | 24 | 5 | " | " |
| Comparative method | 25 | 0.3 | No good | " |
| " | 26 | 6 | Good | No good |

As evident from Table 4, according to the method of the invention, tubes No. 21 thru 24 were all good in the uniformity of the adherence of Zn and the adhesion of Zn. However, in the case of the comparative method, in tube No. 25, the position of flame spraying being too near to the extrusion exit, the appropriate adhering level of Zn was never obtained and, in the case of the comparative method, in tube No. 26, the adhesion of Zn having adhered was poor and the Zn layer was peeled off upon bending processing since the temperature of tubes was lowered to less than 300° C.

As described, in accordance with the invention, by using an Al-Cu alloy or an Al-Cu-Mn alloy for the flat multihole tube, the R portions of tube can be sufficiently made anticorrosive even if Zn may not be adhering thereto. Consequently, the flame spraying and the covering with Zn are possible together with simultaneous extrusion of a plurality of tubes permitting the provision of flame sprayed tubes high in productivity and advantageous in cost. For this reason and others, the invention exerts a remarkable effect industrially.

What is claimed is:

1. A method of manufacturing extruded flat multihole aluminum tubes for heat exchangers, including the steps of:

hot extruding a plurality of flat multiple hole Al-Cu or Al-Cu-Mn tubes side by side in the longitudinal direction; and substantially simultaneously flame spraying Zn onto both even surfaces of the tubes in the vicinity of the extrusion exit of the tubes to cover both even surfaces of the extruded tubes with Zn.

2. The method of manufacturing extruded flat multihole aluminum tubes for heat exchangers according to claim 1, further including covering both even surfaces of the tubes with Zn in amounts of 3 to 30 $g/m^2$.

3. The method of manufacturing extruded flat multihole aluminum tubes for heat-exchangers according to claims 1 or 2, wherein Zn is flame sprayed onto both even surfaces of the tubes at a position 0.5 to 5 m apart from the face of the extrusion exit of the tubes.

4. The method of manufacturing extruded flat multihole aluminum tubes for heat exchangers according to claims 1 or 2 wherein the space between respective tubes which are side by side in the longitudinal direction is 3 to 40 mm.

* * * * *